US010755656B2

(12) United States Patent
Li et al.

(10) Patent No.: US 10,755,656 B2
(45) Date of Patent: Aug. 25, 2020

(54) DISPLAY APPARATUS AND COLOR-CALIBRATION METHOD THEREOF

(71) Applicant: Wistron Corp., New Taipei (TW)

(72) Inventors: Yong Qiang Li, New Taipei (TW); Jun Xin Qiu, New Taipei (TW); Zheng Ying Gao, New Taipei (TW); Min Zhou, New Taipei (TW); Ming Yue Geng, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 16/297,545

(22) Filed: Mar. 8, 2019

(65) Prior Publication Data

US 2020/0126498 A1 Apr. 23, 2020

(30) Foreign Application Priority Data

Oct. 23, 2018 (CN) ..... 2018 1 1237343

(51) Int. Cl.
*G09G 3/36* (2006.01)

(52) U.S. Cl.
CPC ... *G09G 3/3607* (2013.01); *G09G 2320/0666* (2013.01); *G09G 2320/0673* (2013.01); *G09G 2320/0693* (2013.01)

(58) Field of Classification Search
CPC ... G09G 2320/0666; G09G 2320/0673; G09G 2320/0693
See application file for complete search history.

(56) References Cited

U.S. PATENT DOCUMENTS

2010/0007741 A1* 1/2010 Imamura ..... H04N 17/02 348/180
2013/0113840 A1 5/2013 Hsu et al.
2018/0139360 A1* 5/2018 Francois ..... H04N 1/6061
2020/0043441 A1* 2/2020 Kim ..... G06T 7/90

FOREIGN PATENT DOCUMENTS

TW 200812402 A 3/2008
TW I349491 B 9/2011
TW 201810240 A 3/2018

* cited by examiner

*Primary Examiner* — Nelson M Rosario

(57) ABSTRACT

A display apparatus is provided. The display apparatus includes: a display panel, a non-volatile memory, and a controller. The controller is configured to adjust first gain values of the display panel, and obtain two-dimensional color coordinates in a first predetermined color space of the white screen displayed by the display apparatus as white-color coordinates. The controller further adjusts colors displayed by the display apparatus to fit a second predetermined color space, calculates second gain values in the second predetermined color space according to the white-color coordinates, and stores the second gain values in a color-calibration setting in a non-volatile memory of the display apparatus. In response to a selection signal from the display apparatus, the controller reads the color-calibration setting corresponding to the selection signal from the non-volatile memory for execution to perform color calibration on the display apparatus.

6 Claims, 4 Drawing Sheets

Movie
Game
Color Match
User Color

FIG. 3A

Step+2
Step+1
Prefer
Step-1
Step-2

FIG. 3B

DISPLAY APPARATUS AND COLOR-CALIBRATION METHOD THEREOF

CROSS REFERENCE TO RELATED APPLICATIONS

This Application claims priority of China Patent Application No. 201811237343.4, filed on Oct. 23, 2018, the entirety of which is incorporated by reference herein.

BACKGROUND OF THE DISCLOSURE

Field of the Disclosure

The disclosure relates to color calibration, and, in particular, to a display apparatus and a color-calibration method thereof.

Description of the Related Art

In the liquid-crystal display industry, different panel suppliers use different backlights, filters, and liquid-crystal sequencing designs, and so the liquid-crystal panels produced by each panel supplier may have different display characteristics, such as specific color tones of warmer colors or cooler colors. However, liquid-crystal panels produced by different panel suppliers may be used in displays of the same product number, and thus it is easy to cause inconsistency of colors on the displays of the same product number.

Accordingly, there is demand for a display apparatus and color-calibration method thereof to solve the aforementioned problem.

BRIEF SUMMARY OF THE DISCLOSURE

A detailed description is given in the following embodiments with reference to the accompanying drawings.

In an exemplary embodiment, a color-calibration method for use in a display apparatus is provided. The color-calibration method includes the steps of: adjusting first gain values of red, green, and blue colors of the display apparatus such that a white screen displayed by the display apparatus matches that displayed by a reference display apparatus; obtaining two-dimensional color coordinates in a first predetermined color space of the white screen displayed by the display apparatus; setting the two-dimensional color coordinates as white-color coordinates of the display apparatus; adjusting colors displayed by the display apparatus to fit a second predetermined color space; calculating second gain values of the red, green, and blue colors in the second predetermined color space according to the white-color coordinates; storing the calculated second gain values of the red, green, and blue colors in a color-calibration setting in a non-volatile memory of the display apparatus; and in response to a selection signal from the display apparatus, reading the color-calibration setting corresponding to the selection signal from the non-volatile memory for execution to perform color calibration on the display apparatus.

In another exemplary embodiment, a display apparatus is provided. The display apparatus includes: a display panel, a non-volatile memory, and a controller. The controller is configured to adjust first gain values of red, green, and blue colors of the display panel such that a white screen displayed by the display panel matches that displayed by a reference display apparatus, and obtain two-dimensional color coordinates in a first predetermined color space of the white screen displayed by the display apparatus, and set the two-dimensional color coordinates as white-color coordinates of the display apparatus. The controller is further configured to adjust colors displayed by the display apparatus to fit a second predetermined color space, calculate second gain values of the red, green, and blue colors in the second predetermined color space according to the white-color coordinates, and store the calculated second gain values of the red, green, and blue colors in a color-calibration setting in a non-volatile memory of the display apparatus. In response to a selection signal from the display apparatus, the controller reads the color-calibration setting corresponding to the selection signal from the non-volatile memory for execution to perform color calibration on the display apparatus.

BRIEF DESCRIPTION OF THE DRAWINGS

The disclosure can be more fully understood by reading the subsequent detailed description and examples with references made to the accompanying drawings, wherein:

FIGS. 3A-3B are diagrams of the on-screen-display interfaces in accordance with an embodiment of the disclosure.

DETAILED DESCRIPTION OF THE DISCLOSURE

The following description is made for the purpose of illustrating the general principles of the disclosure and should not be taken in a limiting sense. The scope of the disclosure is best determined by reference to the appended claims.

Figure 1:
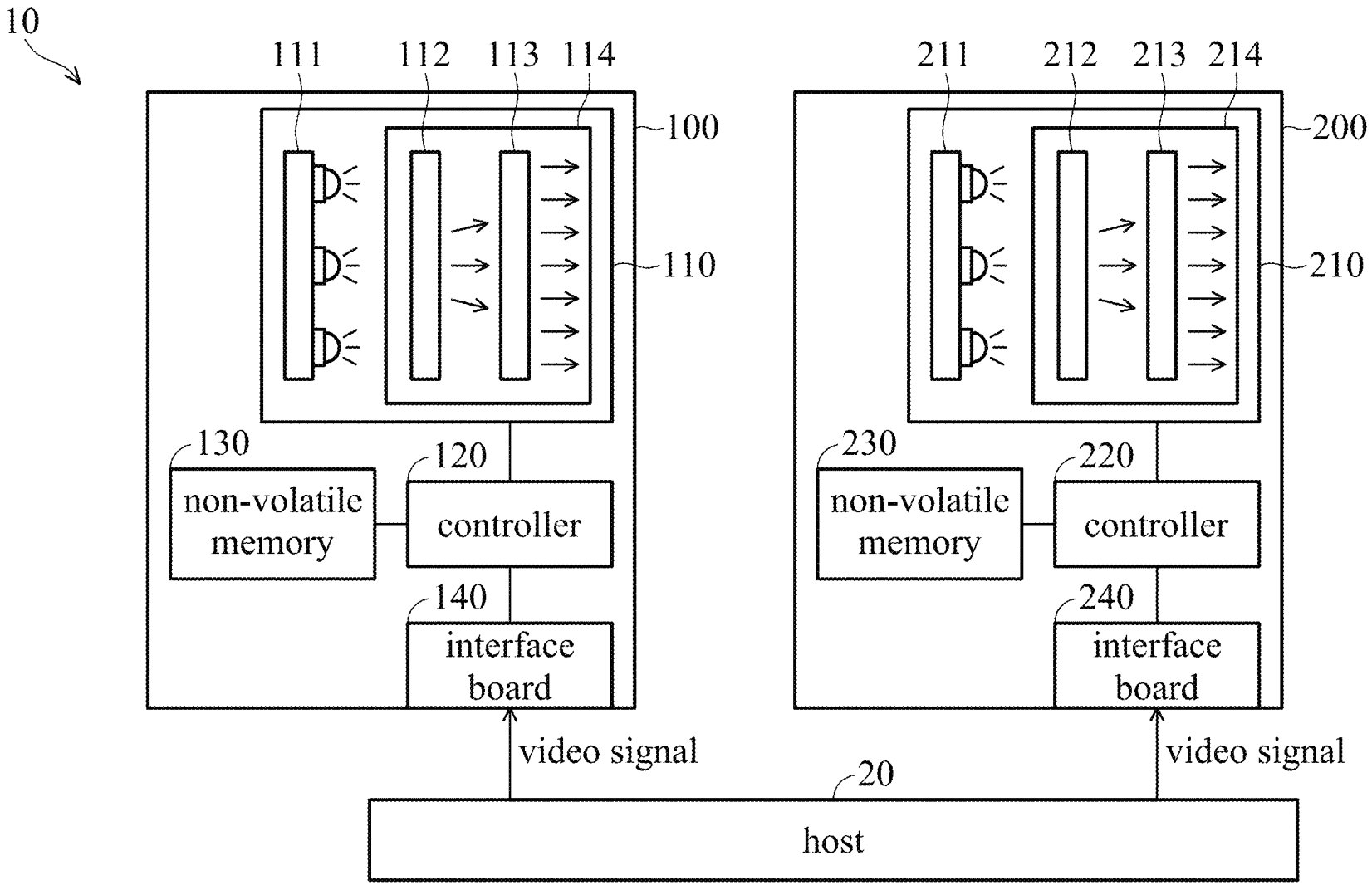
FIG. 1 is a block diagram of a color-calibration system 10 in accordance with an embodiment of the disclosure.

FIG. 1 is a block diagram of a color-calibration system 10 in accordance with an embodiment of the disclosure. The color-calibration system 10 includes a reference display apparatus 100 and one or more display apparatuses 200. In an embodiment, the reference display apparatus 100 includes a display panel 110, a controller 120, a non-volatile memory 130, and an interface board 140. The display panel 110, for example, includes a backlight module 111, a color filter array (CFA) 112, and a liquid-crystal layer 113. The backlight module 111 may be a light source configured to emit light. The color filter array 112 and the liquid-crystal layer 113 may be integrated into a liquid-crystal module 114. The color filter array 112 may include a plurality of red filters, blue filters, and green filters that are arranged in a predetermined pattern to filter red light, blue light, and green light from the light emitted by the background module 111 that are sent to corresponding liquid-crystal cells, thereby achieving the function of displaying images.

The non-volatile memory 130, for example, may be a read-only memory, an erasable programmable read-only memory (EPROM), an electrically-erasable programmable read-only memory (EEPROM), but the disclosure is not limited thereto. The non-volatile memory 130 is configured to store firmware or program code capable of displaying an on-screen display (OSD) interface on the display panel 110, so that the user may adjust the colors displayed by the reference display apparatus via the OSD interface.

The controller 120, for example, may be a microcontroller or a general-purpose processor that is capable of reading the firmware or program code from the non-volatile memory 130 for execution, thereby adjusting the colors displayed by the reference display apparatus 100, wherein the color display settings may include gains for the red, blue, and green colors, and the color temperature.

The interface board 140, for example, may include one or more display interfaces such as a high-definition multimedia interface (HDMI), DisplayPort interface, Thunderbolt interface, Universal Serial Bus (USB) Type-C interface, etc., but the disclosure is not limited thereto. The controller 120, for example, may receive a video signal from a host 20 via one of the display interfaces (e.g., an HDMI interface) of the interface board 140, and display the video signal on the display panel 110 according to the color display settings defined by the firmware. For example, the controller 120 may convert the pixels in the received video signal into corresponding gain values of the red color, green color, and blue color, and the controller 120 may control the corresponding liquid-crystal cells in the liquid-crystal layer 113 to corresponding bias angles, so that the red, green, and blue light can pass through the liquid-crystal layer 113 sequentially and quantitatively, thereby displaying the video images.

The components in the display apparatus 200 may correspond to those in the reference display apparatus 100, and thus the details will be omitted here. In an embodiment, the reference display apparatus 100 and the display apparatus 200, for example, may be display apparatuses of the same product number that use the same type of display panels produced by different panel suppliers. For example, the display panel 110 of the reference display apparatus 100 and the display panel 210 of the display apparatus 200 are both liquid-crystal display panels. In another embodiment, one of the display apparatuses 200 can be selected as the reference display apparatus 100.

In an embodiment, the reference display apparatus 100, for example, can be regarded as a reference white board, and the display apparatus 200 can be regarded as a to-be-tested display apparatus, wherein the white color displayed by the display apparatus 200 can be adjusted to be consistent with the white color displayed by the reference display apparatus 100. For example, the reference display apparatus 100 can be used to display a white screen, that is, all brightness values of the red, blue, and green pixels in the screen are 255. Meanwhile, the gain values for the red, green, and blue colors of the display apparatus 200 can be adjusted, such that the white color displayed by the display apparatus 200 matches that displayed by the reference display apparatus 100.

Afterwards, coordinates (x, y) in a predetermined color space of the adjusted white color displayed by the display apparatus 200 are obtained, and the coordinates (x, y) can be set as the coordinates of the white screen of the display apparatus 200, wherein the predetermined color space may be CIE 1931 XYZ, but the disclosure is not limited thereto. For example, the coordinates (x, y) can be measured by a color analyzer or obtained from an external device.

In the embodiment, the obtained coordinates (x, y) may be (0.308, 0.312). In some embodiments, the coordinates for the white color can be adjusted stepwise, for example, a predetermined step can be adjusted upward or downward, and the x coordinate is increased or decreased by a first predetermined value each time the order is adjusted upward or downward, and the y coordinate is increased or decreased by a second predetermined value each time the order is adjusted upward or downward, wherein the first predetermined value is different from the second predetermined value. For example, the first predetermined value may be 0.2, and the second predetermined value may be 0.1, but the disclosure is not limited thereto.

In the embodiment, the obtained coordinates (x, y)=(0.308, 0.312) are used as a reference (e.g., step 0). If the step is adjusted to +1, the coordinates (x, y) is adjusted to (0.310, 0.313). If the step is adjusted to +2, the coordinates (x, y) are adjusted to (0.312, 0.314). If the step is adjusted to −1, the coordinates (x, y) is adjusted to (0.306, 0.311). If the step is adjusted to −2, the coordinates (x, y) are adjusted to (0.304, 0.310).

Subsequently, the color of the display apparatus 200 is adjusted to match a predetermined color space, wherein the predetermined color space, for example, may be an sRGB color space, but the disclosure is not limited thereto. For example, the gamma value of the display apparatus 200 can be measured, and the measured gamma value can be adjusted to match that in the sRGB color space. Then, a specific-pattern image can be displayed on the display apparatus 200, such as a gray-level image having red, green, and blue pixel values of 128, and the color parameters of the specific-pattern image can be obtained.

Figure 2:
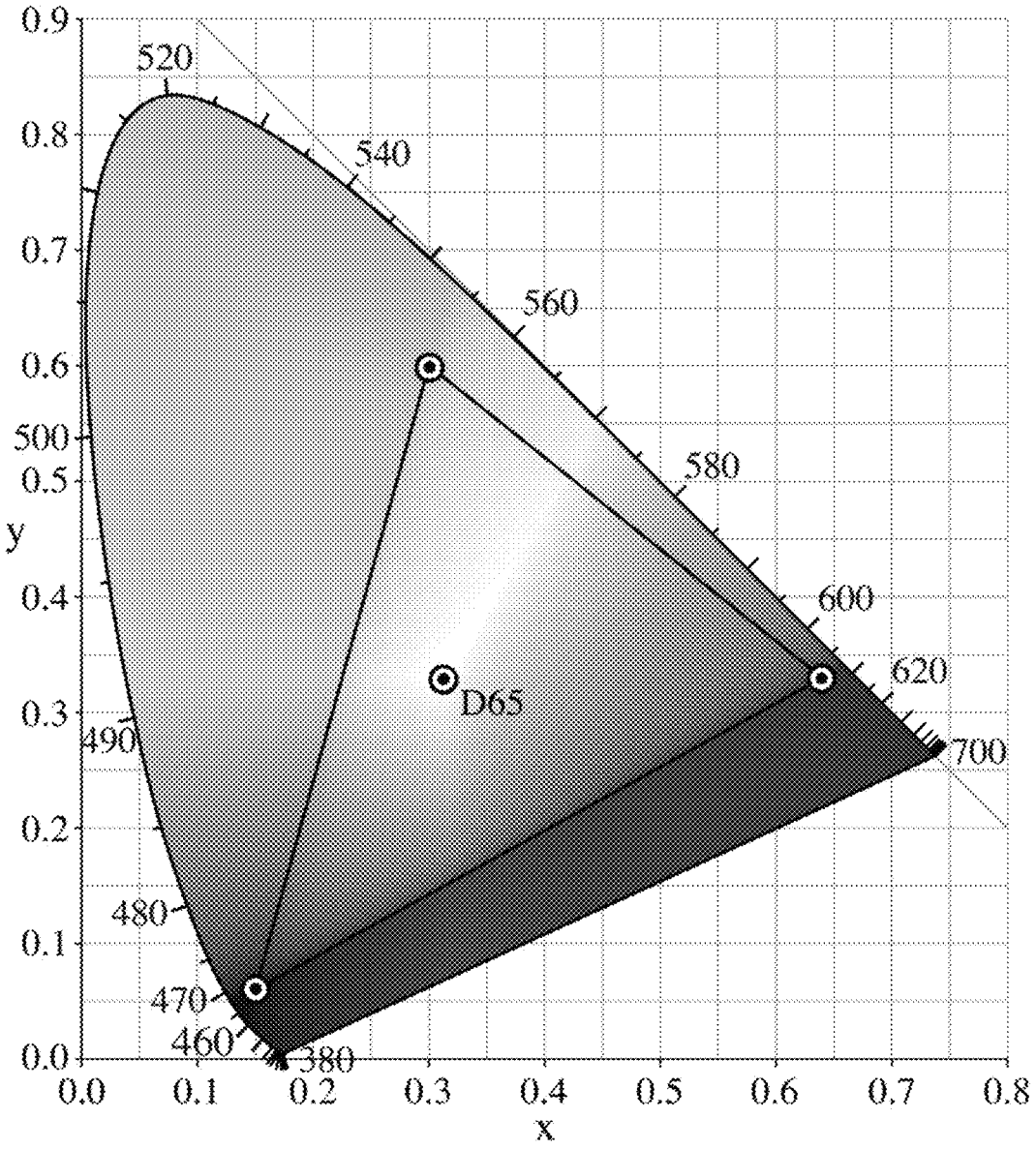
FIG. 2 is a color-gamut diagram of the CIE XYZ 1931 color space and sRGB color space in accordance with an embodiment of the disclosure.

For example, the sRGB color space may define the maximum value of each of the three primary colors of red, green, and blue colors while the values of the other two colors are zero. In the CIE xy color-coordinate system, the red color is located at (0.6400, 0.3300), and the green color is located at (0.3000, 0.6000), and the blue color is located (0.1500, 0.0600), and the white color is located at point D65 having coordinates (0.3127, 0.3290), as shown in FIG. 2. The range of the outer circle represents the color gamut of the CIE xy color space, and the triangle in the inner circle represents the color gamut of the sRGB color space. In addition, the sRGB color space further defines the non-linear conversion curve between the primary color strength and the actually stored values. The curve defined in the sRGB color space is similar to the gamma response curve in a cathode-radiation tube (CRT) display.

Afterwards, based on the sRGB color space, the measured coordinates (x, y)=(0.308, 0.312) of the display apparatus 200 are used to calculate the values for the red, green, and blue colors required by the adjusted white screen displayed by the display apparatus 200. For example, if the three primary colors in the sRGB color space are to be calculated from the coordinates in the CIE xyY coordinate system, the CIE xyY coordinate system should be converted to the CIE XYZ mode, such as:

$$X = \frac{Y}{y}x \tag{1}$$

$$Z = \frac{Y}{y}(1 - x - y) \tag{2}$$

By substituting coordinates (x, y)=(0.308, 0.312), and Y for the default brightness value of 0.8 into equations (1) and (2), respectively, the values of X and Z can be obtained, such as X=0.308*(0.8/0.312)=0.789744; Z=(0.8/0.312)*(1-0.308-0.312)=0.974359. It should be noted that, x and y denote the three-color coefficient, and X, Y, and Z denote tristimulus values.

Accordingly, the calculated X, Y, and Z values in the CIE XYZ color space can be converted into linear R, G, B values using the following matrix equation (3):

$$\begin{bmatrix} R_{linear} \\ G_{linear} \\ B_{linear} \end{bmatrix} = \begin{bmatrix} 3.240479 & -1.53715 & -0.498535 \\ -0.969256 & 1.875991 & 0.041556 \\ 0.055648 & -0.204043 & 1.057311 \end{bmatrix} \begin{bmatrix} X \\ Y \\ Z \end{bmatrix} \quad (3)$$

It should be noted that the linear values $R_{linear}$, $G_{linear}$, and $B_{linear}$ obtained using the matrix operations in equation (3) are not the final results. The linear values $R_{linear}$, $G_{linear}$, and $B_{linear}$ are located in the range of [0, 1], but the sRGB color space may reflect the color effect of a typical display having a gamma value of 2.2 in the real world. Accordingly, the linear values $R_{linear}$, $G_{linear}$, and $B_{linear}$ can be converted to the values $R_{srgb}$, $G_{srgb}$, and $B_{srgb}$ in the sRGB color space using equation (4) which is expressed below:

$$C_{srgb} = \begin{cases} 12.92C_{linear}, & C_{linear} \leq 0.0031308 \\ (1+a)C_{linear}^{\frac{1}{2.4}} - a, & C_{linear} > 0.0031308 \end{cases} \quad \text{where } a = 0.55 \quad (4)$$

In equation (4), the value of $C_{linear}$ may be $R_{linear}$, $G_{linear}$, or $B_{linear}$, and the value of $C_{srgb}$ may denote the value of $R_{srgb}$, $G_{srgb}$, or $B_{srgb}$ using the value of $R_{linear}$, $G_{linear}$, or $B_{linear}$.

Accordingly, the values of $R_{linear}$, $G_{linear}$, and $B_{linear}$ can be substituted in equation (4) to calculate the values of $R_{srgb}$, $G_{srgb}$, and $B_{srgb}$, such as:

$$R_{srgb}=(1+0.055)*(0.84355\hat{}1/2.4)-0.055=0.9278;$$

$$G_{rsgb}=(1+0.055)*(0.77509\hat{}1/2.4)-0.055=0.894;$$

$$B_{srgb=(}1+0.055)*(0.0.911\hat{}1/2.4)-0.055=0.9598$$

Since the range of brightness in the sRGB color space is between 0 and 255, the calculated values of $R_{srgb}$, $G_{srgb}$, and $B_{srgb}$ can be respectively multiplied with the brightness values of the red, green, and blue pixels of the white screen, for example, being 255. Accordingly, the brightness value of the red, green, and blue pixels of the white screen displayed by the display apparatus 200 are calculated as:

$$R=255*0.9278=237;$$

$$G=255*0.894=228;$$

$$B=255*0.9598=245$$

It should be noted that the calculated values of $R_{srgb}$, $G_{srgb}$, and $B_{srgb}$ can be regarded as the gain values for the red, green, and blue colors in the white screen. In another embodiment, if the reference display apparatus 100 uses a specific screen in another color as a reference screen, the flow described in the aforementioned embodiment can also be used to calculate the brightness values for the red, green, and blue pixels in the specific screen.

Similarly, based on the flow in the aforementioned embodiment, the brightness values for the red, green, and blue pixels for each of the steps in the display apparatus 200 can be calculated. In response to the predetermined step being adjusted upward or downward by 1 step, the x coordinate is increased or decreased by a first predetermined value, and the y coordinate is increased or decreased by a second predetermined value, wherein the first predetermined value may be 0.2, and the second predetermined value may be 0.1, but the disclosure is not limited thereto. For example, the measured coordinates (x, y)=(0.308, 0.312) are used as a reference (e.g., step 0). If the step is adjusted to step +1, the coordinates (x, y) is adjusted to (0.310, 0.313). If the step is adjusted to step +2, the coordinates (x, y) are adjusted to (0.312, 0.314). If the step is adjusted to step −1, the coordinates (x, y) are adjusted to (0.306, 0.311). If the step is adjusted to step −2, the coordinates (x, y) are adjusted to (0.304, 0.310). However, the disclosure is not limited to the aforementioned number of steps and the calculated coordinates (x, y).

In response to the gain values for the red, green, and blue colors for each of the five steps (including step 0) being calculated, the gain values for the red, green, and blue colors of the 5 steps can be stored into 5 different settings in the non-volatile memory 230 of the display apparatus 200. For example, the controller 220 may execute the firmware stored in the non-volatile memory 230 to display an OSD interface on the display panel 210, wherein the quick-setting menu of the OSD interface, for example, may include options of "Movie", "Game", "Color Match", and "User Color", as shown in FIG. 3A.

In response to the option "Color Match" being selected, a sub-menu for the "Color Match" option pops up, which includes options of "Prefer" and steps 1, 2, −1, and −2, as shown in FIG. 3B. In response to the display apparatus 200 displaying the white screen and the "Prefer" option being selected, the controller 220 may read the gain values for the red, green, and blue colors corresponding to the "Prefer" option from the non-volatile memory 230, and adjust the currently displayed white screen of the display apparatus 200 to be consistent with the white screen displayed by the reference display apparatus 100.

In some embodiments, an error may occur when the coordinates (x, y) of the reference display apparatus 100 are measured. Thus, in response to the "Prefer" option being selected, the white screen displayed by the display apparatus 200 is not necessarily consistent to the white screen displayed by the reference display apparatus 100. Meanwhile, the options for different steps in the "Color Match" sub-menu can be used to fine-tune the white screen displayed by the display apparatus 200 to meet the user's needs.

Figure 4:
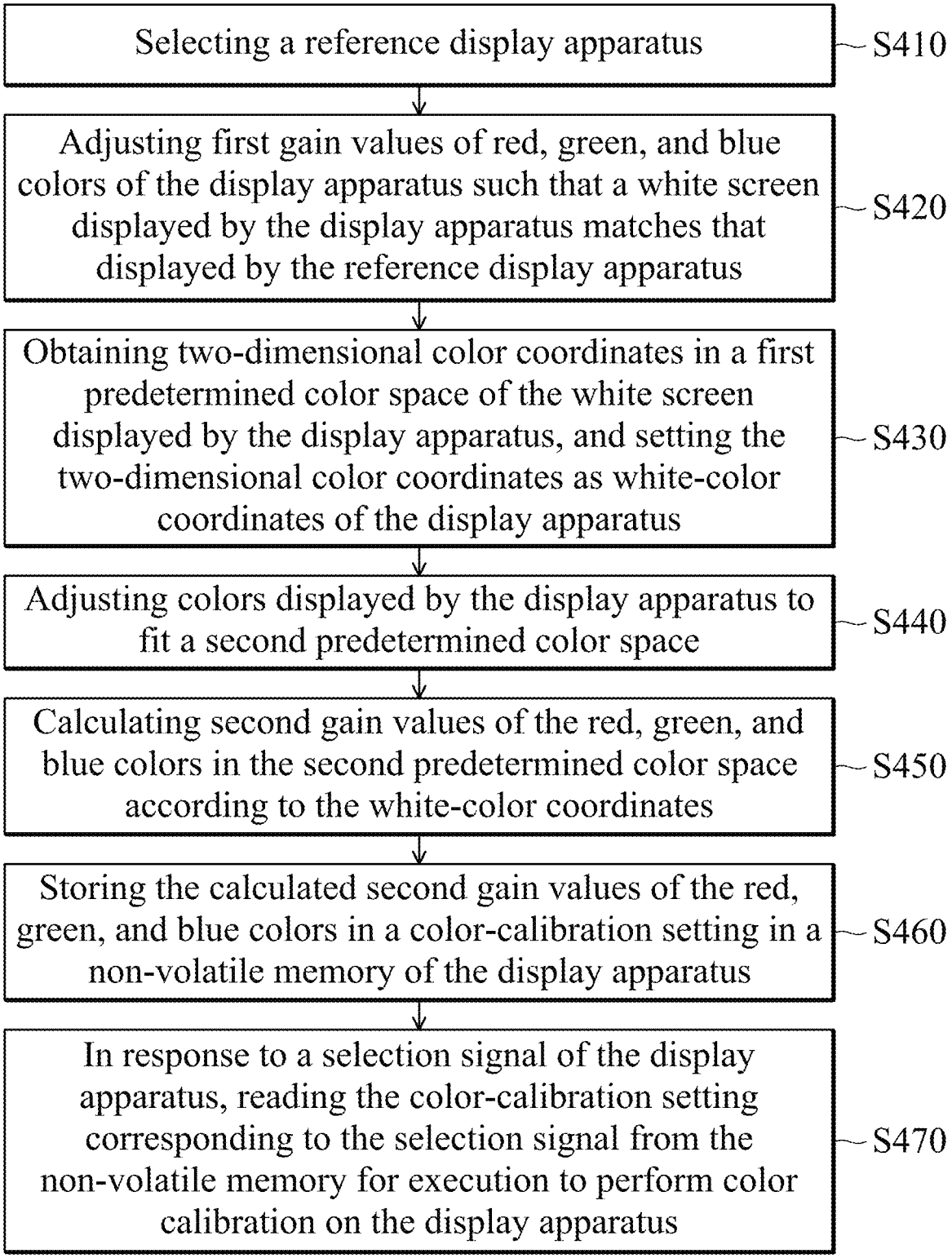
FIG. 4 is a flow chart of a color-calibration method for use in a display apparatus in accordance with an embodiment of the disclosure.

FIG. 4 is a flow chart of a color-calibration method for use in a display apparatus in accordance with an embodiment of the disclosure.

In step S410, a reference display apparatus is selected. For example, the color-calibration system 10 may include a plurality of display apparatuses 200 of the same product number, but display panels produced by different panel suppliers may be used in these display apparatuses 200, and one of the display apparatuses 200 can be selected as the reference display apparatus 100.

In step S420, first gain values of red, green, and blue colors of the display apparatus 200 are adjusted such that a white screen displayed by the display apparatus 200 matches that displayed by the reference display apparatus 100. For example, the display apparatus 200 and the reference display apparatus 100 may be connected to a host 20, and receive a video signal from the host 20 respectively via the interface boards 240 and 140 to display the white screen. Since the display apparatus 200 and the reference display apparatus 100 may use display panels produced by different panel suppliers, the display characteristics of the display apparatus 200 and the reference display apparatus 100 may differ. Thus, the white screen displayed by the display apparatus 200 can be calibrated to be consistent with that displayed by the reference display apparatus 100 by adjusting the gain values of red, green, and blue colors of the display apparatus 200, thereby facilitating performing subsequent steps for color calibration.

In step S430, two-dimensional color coordinates (x, y) in a first predetermined color space of the calibrated white screen displayed by the display apparatus 200 are obtained, and the two-dimensional coordinates (x, y) are set to the white-color coordinates of the display apparatus 200, wherein the first predetermined color space may be CIE XYZ 1931, but the disclosure is not limited thereto. For example, the coordinates (x, y) can be measured by a color analyzer or obtained from an external device. If the coordinates (x, y) are measured as (0.308, 0.312), the measured coordinates can be set to the white-color coordinates of the display apparatus 200.

In some embodiments, the white-color coordinates can be adjusted stepwise, such as adjusting a predetermined step upward or downward. Each time the step is adjusted upward or downward by 1 step, the x coordinate will be increased or decreased by a first predetermined value, and the y coordinate will be increased or decreased by a second predetermined value, wherein the first predetermined value may be 0.2, and the second predetermined value may be 0.1, but the disclosure is not limited thereto. In the embodiment, the measured coordinates (x, y)=(0.308, 0.312) are used as a reference (e.g., step 0). If the step is adjusted to step +1, the coordinates (x, y) is adjusted to (0.310, 0.313). If the step is adjusted to step +2, the coordinates (x, y) are adjusted to (0.312, 0.314). If the step is adjusted to step −1, the coordinates (x, y) are adjusted to (0.306, 0.311). If the step is adjusted to step −2, the coordinates (x, y) are adjusted to (0.304, 0.310).

In step S440, the colors displayed by the display apparatus 200 are adjusted to fit a second predetermined color space, wherein the second predetermined color space may be the sRGB color space, but the disclosure is not limited thereto. For example, the gamma value of the display apparatus 200 can be measured, and the measured gamma value can be adjusted to match that in the sRGB color space. Then, a specific-pattern image can be displayed on the display apparatus 200, such as a gray-level image having red, green, and blue pixel values of 128, and the color parameters of the specific-pattern image can be obtained.

In step S450, second gain values of red, green, and blue colors in the second predetermined color space are calculated according to the white-color coordinates. For example, if the three primary colors in the sRGB color space are to be calculated from the coordinates in the CIE xyY coordinate system, the CIE xyY coordinate system should be converted to the CIE XYZ coordinate system. For example, the controller 220 may convert the coordinates (x, y) from the CIE xyY coordinate system to the CIE XYZ system using equations (1) and (2), wherein Y is a fixed value.

Then, the controller 220 may convert the values of X, Y, and Z in the CIE XYZ color space to linear RGB values such as $R_{linear}$, $G_{linear}$, and $B_{linear}$ using equation (3), and the linear values $R_{linear}$, $G_{linear}$, and $B_{linear}$ can be substituted in equation (4) to calculate the values of $R_{srgb}$, $G_{srgb}$, and $B_{srgb}$ in the sRGB color space. Since the brightness range in the sRGB color space is between 0 and 255, the calculated of $R_{srgb}$, $G_{srgb}$, and $B_{srgb}$ (i.e., gain values of red, green, and blue colors) can be respectively multiplied with the brightness values of the red, green, and blue pixels (e.g., all 255) in the white screen. Accordingly, the brightness values of red, green, and blue colors in the white screen displayed by the display apparatus 200 can be obtained.

In step S460, the calculated gain values of red, green, and blue colors are stored in a color-calibration setting in the non-volatile memory 230. For example, the calculated gain values of the red, green, and blue colors can be regarded as the default color-calibration setting. In some embodiments, in addition to the obtained coordinates (x, y) being the reference (i.e., step 0), different steps can be set for fine-tuning, such as steps +1, +2, −1, and −2. Thus, the gain values of red, green, blue colors for each step (including step 0) can be calculated in a similar manner. Then, the controller 220 may store five sets of gain values of red, green, and blue colors into five different color-calibration settings in the non-volatile memory 230 of the display apparatus 200.

For example, the controller 220 may execute the firmware stored in the non-volatile memory 230 to display an OSD interface on the display panel 210, wherein the quick-setting menu of the OSD interface, for example, may include options of "Movie", "Game", "Color Match", and "User Color", as shown in FIG. 3A. If one color-calibration setting is stored, in response to the option "Color Match" being selected, the controller 220 may directly read the default color-calibration setting (e.g., the "Color Match" setting) to adjust the screen displayed by the display apparatus, as shown in FIG. 3A. If five color-calibration settings are stored, in response to the option "Color Match" being selected, a sub-menu for the "Color Match" option pops up, which includes options of "Prefer" and steps 1, 2, −1, and −2, as shown in FIG. 3B, wherein the "Prefer" option can be regarded as the default color-calibration setting.

In step S470, in response to a selection signal from the display apparatus 200, a color-calibration setting corresponding to the selection signal is read from the non-volatile memory 230 for execution to perform color calibration on the display apparatus 200. In response to the "Prefer" option being selected by the selection signal (e.g., via physical buttons of the display apparatus 200) of the display apparatus 200, the controller 200 may read the gain values of red, green, and blue colors corresponding to the "Prefer" option from the non-volatile memory 230 to calibrate the white screen currently displayed by the display apparatus 200 to be consistent with that displayed by the reference display apparatus 100. If multiple color-calibration settings are stored in the non-volatile memory 230 including the options "Prefer" and multiple steps, the controller 220 may read the gain values of red, green, and blue colors corresponding to the option selected by the selection signal from the non-volatile memory 230 for execution, thereby quickly calibrating the color settings of the display apparatus 200, so that the white screen displayed by the display apparatus 200 can be consistent with that displayed by the reference display apparatus 100.

In view of the above, a display apparatus and a color-calibration method thereof are provided in the disclosure. The display apparatus and the color-calibration method are capable of calibrating the white screen displayed by the display under test to be consistent with that displayed by the reference display apparatus. In addition, multiple color-calibration settings can be stored for fine-tuning colors, thereby quickly calibrating the screen displayed by the display under test to be consistent with that displayed by the reference display apparatus.

The methods, or certain aspects or portions thereof, may take the form of a program code embodied in tangible media, such as floppy diskettes, CD-ROMs, hard drives, or any other machine-readable (e.g., computer-readable) storage medium, or computer program products without limitation in external shape or form thereof, wherein, when the program code is loaded into and executed by a machine such as a computer, the machine thereby becomes an apparatus for practicing the methods. The methods may also be embodied in the form of program code transmitted over some transmission medium, such as an electrical wire or a cable, or through fiber optics, or via any other form of transmission, wherein, when the program code is received and loaded into and executed by a machine such as a computer, the machine becomes an apparatus for practicing the disclosed methods. When implemented on a general-purpose processor, the program code combines with the processor to provide a unique apparatus that operates analogously to application specific logic circuits.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the disclosure has been described by way of example and in terms of the preferred embodiments, it should be understood that the disclosure is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A color-calibration method for use in a display apparatus, comprising:

adjusting first gain values of red, green, and blue colors of the display apparatus such that a white screen displayed by the display apparatus matches that displayed by a reference display apparatus;

obtaining two-dimensional color coordinates in a first predetermined color space of the white screen displayed on the display apparatus, and generating other two-dimensional color coordinates of a plurality of steps according to the obtained two-dimensional color coordinates;

setting the white-color coordinates of the display apparatus for each step according to the other two-dimensional color coordinates of each step;

adjusting colors displayed by the display apparatus to fit a second predetermined color space;

calculating second gain values of the red, green, and blue colors in the second predetermined color space for each step according to the white-color coordinates for each step;

storing the calculated second gain values of the red, green, and blue colors for each step into a color-calibration setting corresponding to each step in a non-volatile memory of the display apparatus; and in response to a selection signal from the display apparatus, reading the color-calibration setting corresponding to the selection signal from the non-volatile memory and executing the color-calibration setting to perform color calibration on the display apparatus;

wherein in response to the steps being increased or decreased by one step, a horizontal coordinate of the two-dimensional color coordinates is increased or decreased by a first predetermined value, and a vertical coordinate of the two-dimensional color coordinates is increased or decreased by a second predetermined value, wherein the second predetermined value is different from the first predetermined value.

2. The color-calibration method as claimed in claim 1, wherein the first predetermined color space is CIE XYZ 1931, and the second predetermined color space is sRGB.

3. The color-calibration method as claimed in claim 2, wherein the step of calculating second gain values of the red, green, and blue colors in the second predetermined color space according to the white-color coordinates comprises:

converting the two-dimensional color coordinates into tristimulus values of the first predetermined color space;

performing a matrix operation to convert the tristimulus values into linear values of the red, green, and blue colors; and converting the linear values of the red, green, and blue colors into the second gain values corresponding to the red, green, and blue colors in the second predetermined color space.

4. A display apparatus, comprising:

a display panel;

a non-volatile memory; and a controller, configured to adjust first gain values of red, green, and blue colors of the display panel such that a white screen displayed by the display panel matches that displayed by a reference display apparatus, and obtain two-dimensional color coordinates in a first predetermined color space of the white screen displayed on the display apparatus, generates other two-dimensional color coordinates of a plurality of steps according to the obtained two-dimensional color coordinates, and sets the white-color coordinates of the display apparatus for each step according to the other two-dimensional color coordinates of each step, wherein the controller is further configured to adjust colors displayed by the display apparatus to fit a second predetermined color space, calculate second gain values of the red, green, and blue colors for each step in the second predetermined color space according to the white-color coordinates for each step, and store the calculated second gain values of the red, green, and blue colors for each step into a color-calibration setting corresponding to each step in a non-volatile memory of the display apparatus;

wherein in response to a selection signal from the display apparatus, the controller reads the color-calibration setting corresponding to the selection signal from the non-volatile memory and executes the color-calibration setting to perform color calibration on the display apparatus, wherein in response to the steps being increased or decreased by one step, a horizontal coordinate of the two-dimensional color coordinates is increased or decreased by a first predetermined value, and a vertical coordinate of the two-dimensional color coordinates is increased or decreased by a second predetermined value, wherein the second predetermined value is different from the first predetermined value.

5. The display apparatus as claimed in claim 4, wherein the first predetermined color space is CIE XYZ 1931, and the second predetermined color space is sRGB.

6. The display apparatus as claimed in claim 5, wherein the controller is further configured to convert the two-dimensional color coordinates into tristimulus values of the first predetermined color space, perform a matrix operation to convert the tristimulus values into linear values of the red, green, and blue colors, and convert the linear values of the red, green, and blue colors to the second gain values corresponding to the red, green, and blue colors in the second predetermined color space.

* * * * *